US010095163B2

(12) United States Patent
Kato et al.

(10) Patent No.: US 10,095,163 B2
(45) Date of Patent: Oct. 9, 2018

(54) IMAGE FORMING APPARATUS ACQUIRING ENERGIZED STATE OF A PLURALITY OF HEATERS

(71) Applicant: Konica Minolta, Inc., Tokyo (JP)

(72) Inventors: Shigetaka Kato, Shinshiro (JP); Natsuyo Higashi, Toyokawa (JP); Takahiro Tsujimoto, Toyokawa (JP); Hirotada Seki, Toyokawa (JP); Yoshihiko Hikari, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/623,652

(22) Filed: Jun. 15, 2017

(65) Prior Publication Data

US 2017/0371276 A1 Dec. 28, 2017

(30) Foreign Application Priority Data

Jun. 24, 2016 (JP) ..... 2016-126007

(51) Int. Cl.
*G03G 15/20* (2006.01)

(52) U.S. Cl.
CPC ..... *G03G 15/205* (2013.01)

(58) Field of Classification Search
CPC ..... G03G 15/205
See application file for complete search history.

(56) References Cited

U.S. PATENT DOCUMENTS

2005/0220474 A1* 10/2005 Sato ..... G03G 15/5004 399/69
2006/0222395 A1* 10/2006 Yoda ..... G03G 15/205 399/69

FOREIGN PATENT DOCUMENTS

| | | | |
|---|---|---|---|
| JP | 2000267743 | A | 9/2000 |
| JP | 2001102320 | A | 4/2001 |
| JP | 2009300943 | A | 12/2009 |
| WO | 2011099472 | A1 | 8/2011 |

* cited by examiner

*Primary Examiner* — Sandra Brase
(74) *Attorney, Agent, or Firm* — Lucas & Mercanti, LLP

(57) ABSTRACT

An image forming apparatus that includes a plurality of heaters and in which a combination of each of the heaters to be turned on can be changed includes a current detection unit including a through-type current transformer in which current supply lines are inserted into or wound around a through hole; a turn-on information acquisition unit that acquires information on a turn-on mode indicating the combination of each of the heaters to be turned on as turn-on information; a connection information acquisition unit that acquires connection information on additive polarity connection and subtractive polarity connection of the heaters, wherein the current supply lines include an additive polarity connection line, and a subtractive polarity connection line; and an energization information acquisition unit that acquires information on an energized state of the plurality of heaters as energization information, based on the turn-on information, the connection information, and a current value.

12 Claims, 17 Drawing Sheets

FIG. 4

HEATER INFORMATION TABLE

| HEATER | CONSUMPTION CURRENT | CONNECTION PHASE |
|---|---|---|
| H1 | 5.5A | NORMAL PHASE |
| H2 | 4.5A | REVERSE PHASE |
| H3 | 3.0A | NORMAL PHASE |

FIG. 5

THRESHOLD VALUE TABLE

| TURN-ON MODE | H1 | H2 | H3 | THRESHOLD VALUE |
|---|---|---|---|---|
| 1 | TURN-ON | TURN-ON | TURN-ON | 4.0A |
| 2 | TURN-ON | TURN-ON | TURN-OFF | 1.0A |
| 3 | TURN-ON | TURN-OFF | TURN-ON | 8.5A |
| 4 | TURN-ON | TURN-OFF | TURN-OFF | 5.5A |
| 5 | TURN-OFF | TURN-ON | TURN-ON | 1.5A |
| 6 | TURN-OFF | TURN-ON | TURN-OFF | 4.5A |
| 7 | TURN-OFF | TURN-OFF | TURN-ON | 3.0A |
| 8 | TURN-OFF | TURN-OFF | TURN-OFF | 0.0A |

FIG. 6A

| 4.0A | 0.0A | 1.0A | 1.5A | 3.0A | 4.5A | 5.5A | 8.5A |
|---|---|---|---|---|---|---|---|
| NORMAL | H1 TURN-OFF<br>H2 TURN-OFF<br>H3 TURN-OFF | H3 TURN-OFF | H1 TURN-OFF | H1 TURN-OFF<br>H2 TURN-OFF | H1 TURN-OFF<br>H3 TURN-OFF | H2 TURN-OFF<br>H3 TURN-OFF | H2 TURN-OFF |

FIG. 6B

| 1.0A | 0.0A | 1.5A | 3.0A | 4.0A | 4.5A | 5.5A | 8.5A |
|---|---|---|---|---|---|---|---|
| NORMAL | H1 c<br>H2 TURN-OFF | H1 TURN-OFF<br>H3 TURN-ON | H1 TURN-OFF<br>H2 TURN-OFF<br>H3 TURN-ON | H3 TURN-ON | H1 TURN-OFF | H2 TURN-OFF | H2 TURN-OFF<br>H3 TURN-ON |

FIG. 6C

| 8.5A | 0.0A | 1.0A | 1.5A | 3.0A | 4.0A | 4.5A | 5.5A |
|---|---|---|---|---|---|---|---|
| NORMAL | H1 TURN-OFF<br>H3 TURN-OFF | H2 TURN-ON<br>H3 TURN-OFF | H1 TURN-OFF<br>H2 TURN-ON | H1 TURN-OFF | H2 TURN-ON | H1 TURN-OFF<br>H2 TURN-ON<br>H3 TURN-OFF | H3 TURN-OFF |

FIG. 6D

| 5.5A | 0.0A | 1.0A | 1.5A | 3.0A | 4.0A | 4.5A | 8.5A |
|---|---|---|---|---|---|---|---|
| NORMAL | H1 TURN-OFF | H2 TURN-ON | H1 TURN-OFF<br>H2 TURN-ON<br>H3 TURN-ON | H1 TURN-OFF<br>H3 TURN-ON | H2 TURN-ON<br>H3 TURN-ON | H1 TURN-OFF<br>H2 TURN-ON | H3 TURN-ON |

FIG. 8

| 0.0A | 1.0A | 1.5A | 3.0A | 4.0A | 4.5A | 5.5A | 8.5A |
|---|---|---|---|---|---|---|---|
| NORMAL | H1 TURN-ON<br>H2 TURN-ON | H2 TURN-ON<br>H3 TURN-ON | H3 TURN-ON | H1 TURN-ON<br>H2 TURN-ON<br>H3 TURN-ON | H2 TURN-ON | H1 TURN-ON | H1 TURN-ON<br>H3 TURN-ON |

FIG. 13

HEATER INFORMATION TABLE

| HEATER | CONSUMPTION CURRENT | CONNECTION PHASE |
|---|---|---|
| H1 | 5.5A | NORMAL PHASE |
| H2 | 3.5A×2 | REVERSE PHASE |
| H3 | 3.5A | NORMAL PHASE |

FIG. 14

THRESHOLD VALUE TABLE

| TURN-ON MODE | H1 | H2 | H3 | THRESHOLD VALUE |
|---|---|---|---|---|
| 1 | TURN-ON | TURN-ON | TURN-ON | 2.0A |
| 2 | TURN-ON | TURN-ON | TURN-OFF | 1.5A |
| 3 | TURN-ON | TURN-OFF | TURN-ON | 9.0A |
| 4 | TURN-ON | TURN-OFF | TURN-OFF | 5.5A |
| 5 | TURN-OFF | TURN-ON | TURN-ON | 3.5A |
| 6 | TURN-OFF | TURN-ON | TURN-OFF | 7.0A |
| 7 | TURN-OFF | TURN-OFF | TURN-ON | 3.5A |
| 8 | TURN-OFF | TURN-OFF | TURN-OFF | 0.0A |

FIG. 16

HEATER INFORMATION TABLE

| HEATER | CONSUMPTION CURRENT | CONNECTION PHASE |
|---|---|---|
| H1 | 5.5A | NORMAL PHASE |
| H2 | 4.5A | NORMAL PHASE |
| H3 | 3.0A | REVERSE PHASE |
| POWER SUPPLY UNIT | 1.5 TO 3.5A | REVERSE PHASE |

FIG. 17

NORMAL TURN-ON CURRENT VALUE RANGE TABLE

| TURN-ON MODE | H1 | H2 | H3 | NORMAL TURN-ON CURRENT VALUE RANGE |
|---|---|---|---|---|
| 1 | TURN-ON | TURN-ON | TURN-ON | 3.5 TO 5.5A |
| 2 | TURN-ON | TURN-ON | TURN-OFF | 6.5 TO 8.5A |
| 3 | TURN-ON | TURN-OFF | TURN-ON | 0.0 TO 1.0A |
| 4 | TURN-ON | TURN-OFF | TURN-OFF | 2.0 TO 4.0A |
| 5 | TURN-OFF | TURN-ON | TURN-ON | 0.0 TO 2.0A |
| 6 | TURN-OFF | TURN-ON | TURN-OFF | 1.0 TO 3.0A |
| 7 | TURN-OFF | TURN-OFF | TURN-ON | 4.5 TO 6.5A |
| 8 | TURN-OFF | TURN-OFF | TURN-OFF | 1.5 TO 3.5A |

IMAGE FORMING APPARATUS ACQUIRING ENERGIZED STATE OF A PLURALITY OF HEATERS

The entire disclosure of Japanese Patent Application No. 2016-126007 filed on Jun. 24, 2016 including description, claims, drawings, and abstract are incorporated herein by reference in its entirety.

BACKGROUND OF THE INVENTION

Field of the Invention

The present invention relates to an image forming apparatus, and in particular relates to a technique for acquiring an energized state of a plurality of heaters when the heaters are included as heat sources of a fixing apparatus.

Description of the Related Art

In an electrophotographic image forming apparatus such as a copying machine or a printer, a toner image transferred on a recording sheet is pressed and heated by a heating rotating body (heating roller) of a fixing device to be fixed on the recording sheet.

Normally, a heater is disposed inside the heating rotating body, and power is supplied to the heater via a switching device such as a triac, and temperature of the heating rotating body is controlled to a predetermined value.

In turn-on control for such a heater, for example, when the switching device breaks down, there is a possibility that the heater is always turned on or always turned off, so that current supplied to the heater is preferably detected by using a current detector.

As such a current detector, in particular, a so-called through-type current transformer is often used in which a current supply line is inserted into a through hole at the center portion of a ring-shaped core, and a current value according to a current flowing through the current supply line is output from a secondary winding line wound around the core (for example, JP 2009-300943 A and WO 2011/099472 A).

FIG. 18 is a schematic diagram illustrating a configuration of a through-type current transformer 320. A current supply line 323 to a heater is inserted into a through hole at the center of a ring-shaped core (magnetic material core) 321 (or is wound around the core 321), and when a current I1 is supplied, magnetic flux occurs inside the core 321, a current occurs in a secondary winding line 322 wound around the core 321, and a current 12 flows through a load resistor 324. A voltage E generated across the load resistor 324 at this time is subjected to AD conversion, whereby the current value supplied to the heater can be detected.

In recent years, a demand for energy saving of the fixing device has been increased. To meet the demand, only a necessary portion of the heating rotating body is preferably heated in accordance with a sheet size and the like, and as a counter measure to that, a configuration (partial heater configuration) is adopted in which a heated portion is subdivided in a longitudinal direction of the heating rotating body and a plurality of heaters is used.

In an example in FIG. 19, three heaters H1, H2, H3 are incorporated inside a fixing roller 301. A control unit 302 controls operations of triacs 314 to 316, and controls power supply from a commercial AC power supply 312 to the heaters H1 to H3.

Current supply lines of the respective heaters H1 to H3 are inserted into through-type current transformers 303 to 305, respectively. Currents generated in secondary winding line sides of the respective current transformers 303 to 305 are supplied to load resistors 306 to 308, respectively, and voltages generated across the respective load resistors 306 to 308 are subjected to AD conversion in current detection circuits 309 to 311, respectively, and detection results are transmitted to the control unit 302 as detected current values.

Thus, the control unit 302 can obtain information on currents supplied to the heaters H1 to H3, and if it is determined that there is an energization abnormality in any of heaters H1 to H3 (including a case where the heater is not energized due to disconnection of the heater or the like when the heater should be turned on, and a case where the heater is energized due to a failure of the triac or the like when the heater should be turned off), a relay 313 is operated to shut off energization to all heaters H1 to H3.

However, in the above configuration, since the current transformer, the load resistor, the current detection circuit, and the like are necessary for each of the plurality of heaters, cost increase cannot be avoided.

Therefore, a method can be considered in which the current supply lines of the plurality of heaters H1 to H3 are inserted into a through hole of one current transformer 317 in the same direction (the same phase), and an actual detected current value obtained via a load resistor 318, a current detection circuit 319 is compared with a detected current value of the current transformer 317 predicted in advance in accordance with a combination state of turn-on of the heater grasped by the control unit 302, and an energized state to the heaters is detected, as illustrated in FIG. 20; however, there is a problem that, in an inexpensive current transformer, when all heaters are energized, a sum total of the consumption current exceeds a detection capability of the current transformer and saturation occurs, and an accurate current value cannot be measured.

For that reason, it is necessary to use a large current type current transformer, and cost increase cannot be avoided also in this case.

SUMMARY OF THE INVENTION

The present invention has been made in view of the above circumstances, and it is an object to provide an image forming apparatus capable of acquiring heater energization information as inexpensively as possible when a plurality of heaters is provided in a fixing unit.

To achieve the abovementioned object, according to an aspect, there is provided an image forming apparatus that includes a plurality of heaters as a heat source of a heating rotating body of a fixing unit and in which a combination of each of the heaters to be turned on can be changed, and the image forming apparatus reflecting one aspect of the present invention comprises: a current detection unit including a through-type current transformer in which current supply lines are inserted into or wound around a through hole at a center portion of a ring-shaped core; a turn-on information acquisition unit that acquires information on a turn-on mode indicating the combination of each of the heaters to be turned on as turn-on information; a connection information acquisition unit that acquires connection information on additive polarity connection and subtractive polarity connection of the heaters, wherein the current supply lines to the plurality of heaters include an additive polarity connection line inserted into or wound around the through hole of the core of the current transformer in additive polarity, and a subtractive polarity connection line inserted into or wound around the through hole of the core of the current transformer in subtractive polarity; and an energization information acquisition unit that acquires information on an energized state of the plurality of heaters as energization information, based on the turn-on information, the connection information, and a current value output from the current detection unit.

Here, the image forming apparatus preferably further comprises: a predicted value acquisition unit that acquires a predicted value predicted to be output from the current detection unit in a present turn-on mode; a verification unit that performs verification of the predicted value with a current value actually output from the current detection unit; and a determination unit that determines whether or not the energized state is abnormal, based on a result of the verification.

Furthermore, the predicted value acquisition unit preferably calculates and acquires the predicted value, based on a consumption current value assumed for each of the heaters, the turn-on information, and connection information of each of the heaters.

Furthermore, based on a consumption current value assumed for each of the heaters, the turn-on information, and connection information of each of the heaters, the predicted value is preferably obtained in advance for each turn-on mode and stored as a table, and the predicted value acquisition unit preferably reads and acquires a predicted value corresponding to a present turn-on mode from the table.

Furthermore, the determination unit preferably determines that the energized state is abnormal when a current is detected in the current detection unit during execution of a turn-on mode in which all heaters are to be turned off.

Furthermore, the image forming apparatus preferably further comprises a shut off unit that shuts off supply of power to the plurality of heaters when the determination unit determines that the energized state is abnormal.

Furthermore, when there are two or more heaters each having an identical assumed consumption current among the plurality of heaters, a difference is preferably provided in the number of turns to be wound around the core of the current transformer of the current supply lines of respective heaters.

Furthermore, the image forming apparatus preferably further comprises a control unit that turns on the plurality of heaters in different turn-on modes, and based on an output value of the current detection unit in each of the turn-on modes, acquires a measured value of a consumption current of each of the heaters, and calculates a total consumption current of each of the heaters being turned on, from a present turn-on mode and the acquired measured value of the consumption current, and controls the consumption current of the entire apparatus, based on the calculated value.

Furthermore, the image forming apparatus preferably further comprises a power-supply-unit-consumption-current acquisition unit that acquires a consumption current of a power supply unit including at least a low voltage power supply, other than the heaters of the apparatus, and the control unit, when a sum total of measured values of the consumption current of the power supply unit and the consumption current of each of the heaters being turned on exceeds a specified value, preferably switches a combination of turn-on of the plurality of heaters to a combination in which the consumption current is less.

Furthermore, the image forming apparatus preferably further comprises: a total power calculation unit that calculates a sum total of a first power consumption calculated from the total consumption current of each of the heaters being turned on, and a second power consumption calculated from the consumption current of the power supply unit and a power factor set in advance; and a storage unit that stores the calculated sum total of the power consumption.

Furthermore, the current supply lines to the power supply unit are preferably connected to the current transformer of the current detection unit in additive polarity connection or subtractive polarity connection, and the consumption current of the power supply unit is preferably calculated based on the turn-on information, a connection state of the current supply lines to the power supply unit to the current transformer, and the current value output from the current detection unit.

Furthermore, when the number of the plurality of heaters is N, the current detection unit preferably includes a plurality of the current transformers, the number of the current transformers being M less than N, and at least one of the heaters is allocated for each of the current transformers, and, for each of the current transformers to which the plurality of heaters is allocated, a part of the current supply lines of the plurality of allocated heaters is preferably connected in additive polarity, and a rest of the current lines of the heaters is preferably connected in subtractive polarity.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 4 is a diagram illustrating a heater information table;

FIG. 5 is a diagram illustrating a threshold value table;

FIGS. 6A to 6D are tables each illustrating a relationship between a detected current value of a current transformer and an energization abnormality heater, in each turn-on mode during fixing heating;

FIG. 8 is a table illustrating a relationship between a detected current value of the current transformer and an energization abnormality heater, in a turn-on mode during standby;

FIG. 13 is a diagram illustrating an example of a heater information table in the third modification;

FIG. 14 is a diagram illustrating an example of a threshold value table in the third modification;

FIG. 16 is a diagram illustrating an example of a heater information table in the fourth modification;

FIG. 17 is a diagram illustrating an example of a normal turn-on current value range table in the fourth modification;

DESCRIPTION OF THE PREFERRED EMBODIMENTS

Hereinafter, an image forming apparatus according to embodiments of the present invention will be described with reference to the drawings, taking a tandem type color printer (hereinafter, simply referred to as a "printer") as an example. However, the scope of the invention is not limited to the illustrated examples.

(1) Configuration of Printer

Figure 1:
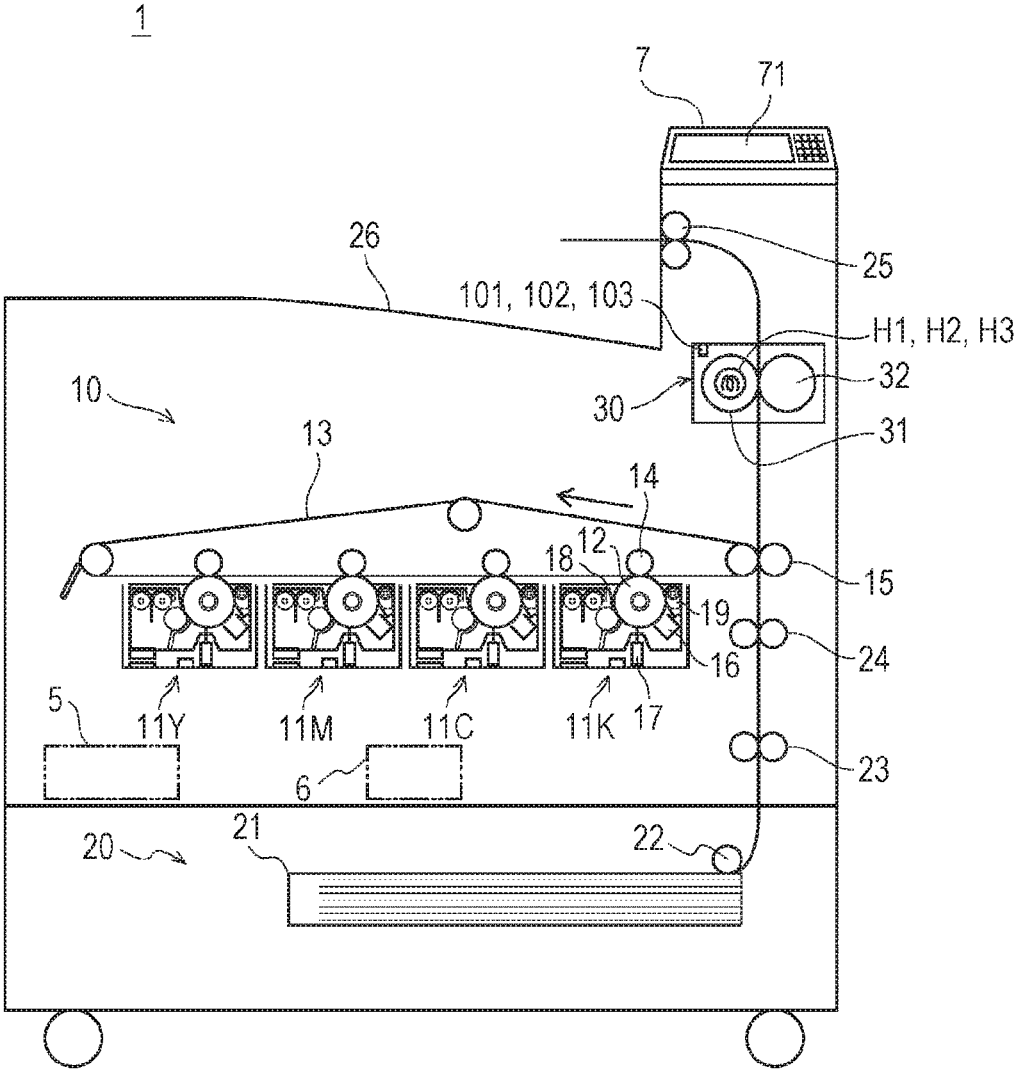
FIG. 1 is a diagram for explaining an entire configuration of a printer according to an embodiment of the present invention.

FIG. 1 is a schematic diagram illustrating an entire configuration of a printer 1 according to the present embodiment.

As illustrated in FIG. 1, the printer 1 includes an image forming unit 10, a sheet feeding unit 20, a fixing unit 30, a control unit 5, a power supply unit 6, and an operation panel 7.

The sheet feeding unit 20 includes a storage tray 21, a feed roller 22, a handling roller 23, a timing roller 24, and a discharge roller 25.

The feed roller 22 comes in contact with the uppermost recording sheet in the storage tray 21, and feeds the sheet to a conveying path on a downstream side.

The handling roller 23 handles recording sheets fed together to separate them one by one, and the timing roller 24 feeds the recording sheet to the downstream side at a timing instructed from the control unit 5.

As illustrated in FIG. 1, the image forming unit 10 includes: imaging units 11Y, 11M, 11C, 11K respectively corresponding to colors Y, M, C, K; an intermediate transfer belt 13; a primary transfer roller 14 facing a photosensitive drum 12 via the intermediate transfer belt 13; and a secondary transfer roller 15.

For example, the imaging unit 11K includes the photosensitive drum 12, a charging unit 16 disposed along a circumferential direction of the photosensitive drum 12, an exposure unit 17, a developing unit 18, and a cleaner 19. Each of the imaging units 11Y, 11M, 11C also has a configuration similar to the imaging unit 11K.

The exposure unit 17 includes a lens and a light emitting device such as a laser diode, and modulates laser light to perform exposure scanning on the photosensitive drum 12 with a drive signal generated by the control unit 5, based on image data acquired from the outside via a LAN and the like.

The photosensitive drum 12 is rotationally driven by a drive source not illustrated, and before being subjected to the exposure, is subjected to remaining toner removal on the surface by the cleaner 19, and then is uniformly charged by the charging unit 16. When the photosensitive drum 12 is subjected to the exposure with the laser light in this uniformly charged state, an electrostatic latent image is formed on the surface of the photosensitive drum 12.

The electrostatic latent image formed on each photosensitive drum 12 is developed by the developing unit 18 for each color, whereby each of Y, M, C, K toner images is imaged on the surface of the photosensitive drum 12.

Imaging operations of the imaging units 11Y to 11C are performed at timings shifted from each other so that the respective toner images are transferred to be superimposed on the same position on the intermediate transfer belt 13. The toner images receive electrostatic force by the primary transfer roller 14 and are transferred onto the intermediate transfer belt 13 in a multiplexed manner, and a color toner image is formed.

Each color toner image superimposed on the intermediate transfer belt 13 is moved to a secondary transfer position by rotation of the intermediate transfer belt 13.

In accordance with a movement timing of the toner image on the intermediate transfer belt 13, a recording sheet is fed from the sheet feeding unit 20 via the timing roller pair 24, and due to electrostatic force generated by a transfer voltage applied to the secondary transfer roller 15, the toner image on the intermediate transfer belt 13 is secondarily transferred onto the recording sheet, and conveyed to the fixing unit 30.

The fixing unit 30 is formed by pressing a pressure roller 32 against a fixing roller 31, whereby a fixing nip is formed between the both rollers.

The pressure roller 32 is driven by a drive source not illustrated, and the fixing roller 31 is driven to rotate in accordance with rotation of the pressure roller 32.

Inside of the fixing roller 31, for example, three types of heaters H1, H2, H3 each including a halogen heater are disposed.

Figure 2:
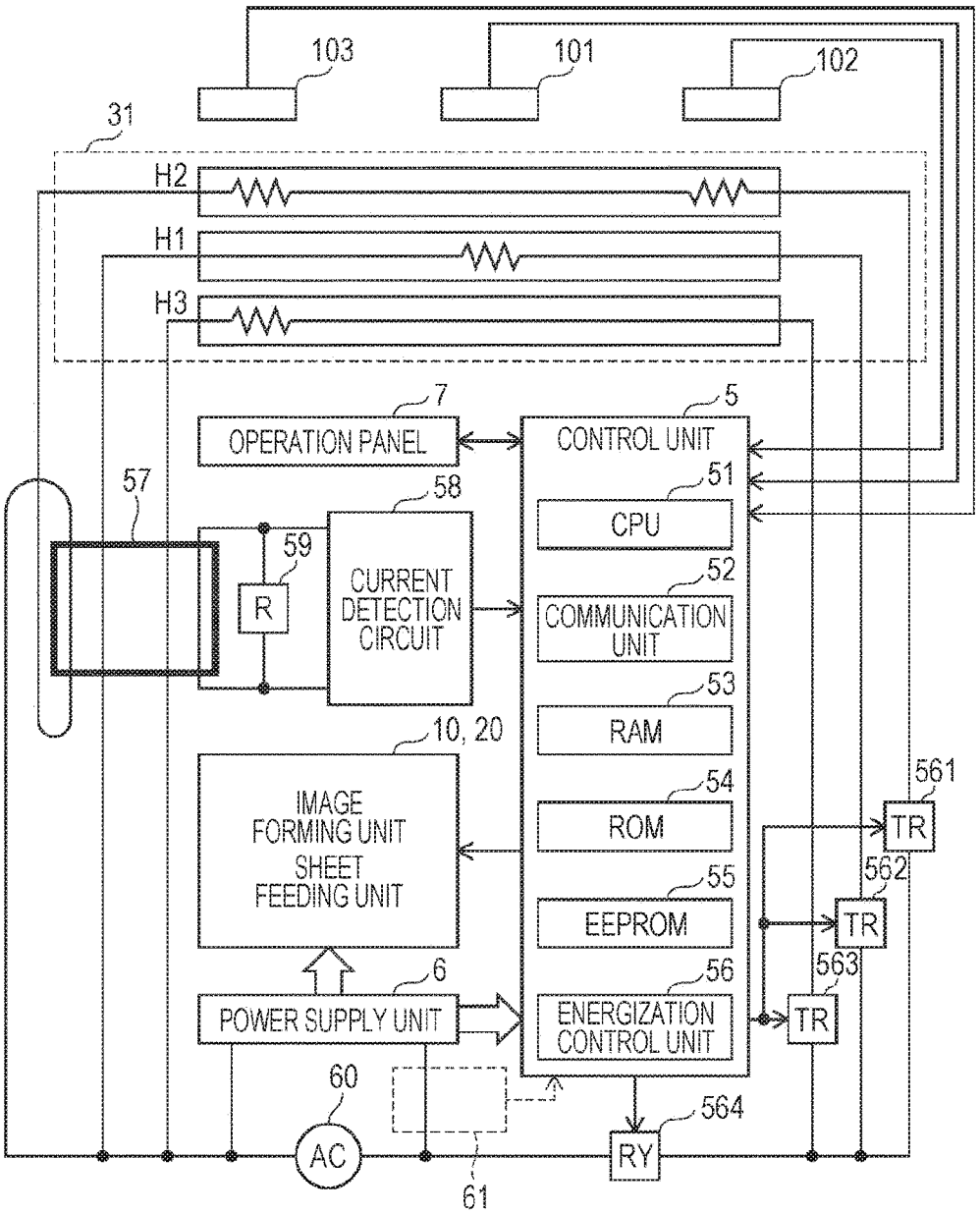
FIG. 2 is a schematic diagram illustrating a connection relationship between a control unit, heaters of a fixing roller, and the like in the printer.

As illustrated in FIG. 2, the heater H1 is a main heater for heating a center portion of the fixing roller 31, and is always turned on during fixing, in the present embodiment. Each of the heaters H2, H3 is an auxiliary heater that complements the heater H1, and an application is allocated so that a necessary part is heated in accordance with a heating state and a sheet size.

Further, the fixing unit 30 is provided with temperature sensors 101 to 103 for detecting surface temperature of the fixing roller 31. The temperature sensor 101 detects a surface temperature in a longitudinal direction center portion of the fixing roller 31, the temperature sensor 102 detects a surface temperature of one end portion of the fixing roller 31, and the temperature sensor 103 detects a surface temperature of the other end portion of the fixing roller 31. The temperature sensors 102, 103 at the end portions maybe omitted in some cases.

Incidentally, thermistors are used as the temperature sensors in the present embodiment; however, not limited thereto, infrared sensors or the like may be used, for example.

Returning to FIG. 1, the recording sheet on which the toner image is transferred passes through the fixing nip of the fixing unit 30, whereby an unfixed toner image is heated and pressed to be thermally fixed on the recording sheet, and then the sheet is discharged to a discharge tray 26 via the pair of discharge rollers 25.

In addition, the power supply unit 6 is connected to a commercial AC power supply 60 of an effective voltage 100 V, and supplies power to parts other than the heaters H1 to H3, and, in the present embodiment, supplies a predetermined low voltage to a drive source in the image forming unit 10 and the sheet feeding unit 20, the control unit 5, and a high voltage power supply for supplying a charging bias, a developing bias, a primary transfer bias, a secondary transfer bias, and the like.

The operation panel 7 includes a hard button such as a numeric keypad, and also a display unit 71 in which a touch panel is layered on a screen surface, and accepts an instruction from an operator, and also displays necessary information to a user via the display unit 71.

The control unit 5 comprehensively controls the image forming unit 10, the sheet feeding unit 20, and the fixing unit 30 to smoothly execute a print operation.

(2) Configuration of Control Unit

FIG. 2 is a schematic diagram illustrating a relationship between a configuration of the control unit 5 and main constituents to be controlled, in the printer 1.

The control unit 5 includes a Central Processing Unit (CPU) 51, a communication unit 52, Random Access Memory (RAM) 53, Read Only Memory (ROM) 54, Electronically Erasable and Programmable Read Only Memory (EEPROM) 55, and an energization control unit 56 for controlling energization to each heater of the fixing unit 30.

The communication unit 52 is an interface for connecting to a LAN, such as a LAN card or a LAN board.

The RAM 53 is a volatile memory, and is a work area during program execution in the CPU 51.

The ROM 54 stores a program for executing control relating to execution of printing and energization control to the heaters described later.

The EEPROM 55 is a nonvolatile memory, and is a storage area for various data and tables described later.

Triacs 561 to 563 shut off and connect energization paths to the respective heaters H1, H2, H3, based on signals output from the energization control unit 56 of the control unit 5.

For example, when turning on the heater H1, the energization control unit 56 outputs a signal (heater turn-on signal) for instructing the triac 562 to perform connection of the energization path, and while the signal is output, the voltage of the commercial AC power supply 60 is applied to the heater H1.

A current detection unit is configured by a current transformer 57, a current detection circuit 58, and a resistor 59. The current transformer 57 in the present embodiment is formed by winding a secondary side coil around a ring-shaped core, and current supply lines to be detected are inserted into or wound around a center portion of the core (hereinafter, simply referred to as "connected to the current transformer").

A current output from the secondary side of the current transformer 57 flows through the resistor 59. The current detection circuit 58 performs AD conversion to a voltage generated across the resistor 59, and thus outputs a root-mean-square value (≥0) of a current corresponding to a magnitude of current supplied to the current supply lines of the heaters connected to the primary side, as a detected value (hereinafter, simply referred to as "a detected current value is output from the current transformer 57").

To the primary side of the current transformer 57, the current supply lines of the heaters H1, H3 are connected to be subtractive polarity in which electromotive force in the same direction is generated in the secondary side (subtractive polarity connection), and the current supply line of the heater H2 is connected to be additive polarity in which electromotive force in the opposite direction is generated in the secondary side (additive polarity connection). However, since it is sufficient that the electromotive force generated in the secondary side by the current flowing through the heaters H1, H2, and the electromotive force generated in the secondary side by the current flowing through the heater H3 have opposite polarities form each other, the combination of the subtractive polarity and the additive polarity may be reversed.

In the through-type current transformer, since the relationship between the subtractive polarity connection and the additive polarity connection as described above is executed by making connections so that AC currents flowing through the current supply lines of the heaters H1, H3 inserted into the through hole of the core have the same phase (normal phase), and an AC current flowing through the current supply line of the heater H2 has the reverse phase to those of the heaters H1, H3, in the following, the subtractive polarity connection and the additive polarity connection are plainly referred to as normal phase connection and reverse phase connection, respectively.

In this way, by connecting the current supply lines of the heaters to one current transformer 57, the number of the current transformers can be reduced. Moreover, since the current supply line of a particular heater of the plurality of heaters is connected to the current transformer 57 so as to have a reverse phase to the other current supply lines, the electromotive force generated in the secondary side is canceled by that amount, the output of the secondary side of the current transformer 57 can be reduced, and use of a current transformer for large output is not necessary, so that space saving and cost reduction are achieved.

The CPU 51 executes a control program stored in the ROM 54, to control the image forming unit 10, the sheet feeding unit 20, and the fixing unit 30, and executes a smooth print operation. In particular, for the fixing unit 30, a heater to be turned on is selected in accordance with detection results of the temperature sensors 101 to 103 and the recording sheet size, and control is executed for energizing the heater to perform heating, and a process is executed for acquiring an energized state to the heaters (hereinafter, referred to as a "energized state acquisition process").

The power supply unit 6 includes a known AC/DC converter and DC/DC converter, and when receiving supply of power from the commercial AC power supply 60 via a power supply switch not illustrated, supplies power at a predetermined voltage to each part other than the heaters H1 to H3, such as the drive source of the image forming unit 10 and the sheet feeding unit 20, and the control unit 5.

(3) Energized State Acquisition Process

Processing contents of the energized state acquisition process by the control unit 5 are slightly different between when the fixing roller 31 is heated (during fixing heating) and when fixing heating is not performed (during standby).

(A) Energized state acquisition process during fixing heating

In the energization information acquisition process during fixing heating, based on signals output from the temperature sensors 101 to 103 of the fixing unit 30 and the sheet size, the control unit 5 outputs to the triacs 561 to 563 the turn-on signals for turning on the heaters H1 to H3 provided inside the fixing roller 31 and maintains the surface temperature of the fixing roller 31 at a target temperature. At the same time, based on a current detection result by the current transformer 57, when it is regarded that an abnormality has occurred in any of the triacs, the control unit 5 turns off a relay 564 to shut off energization to all the heaters.

Figure 3:
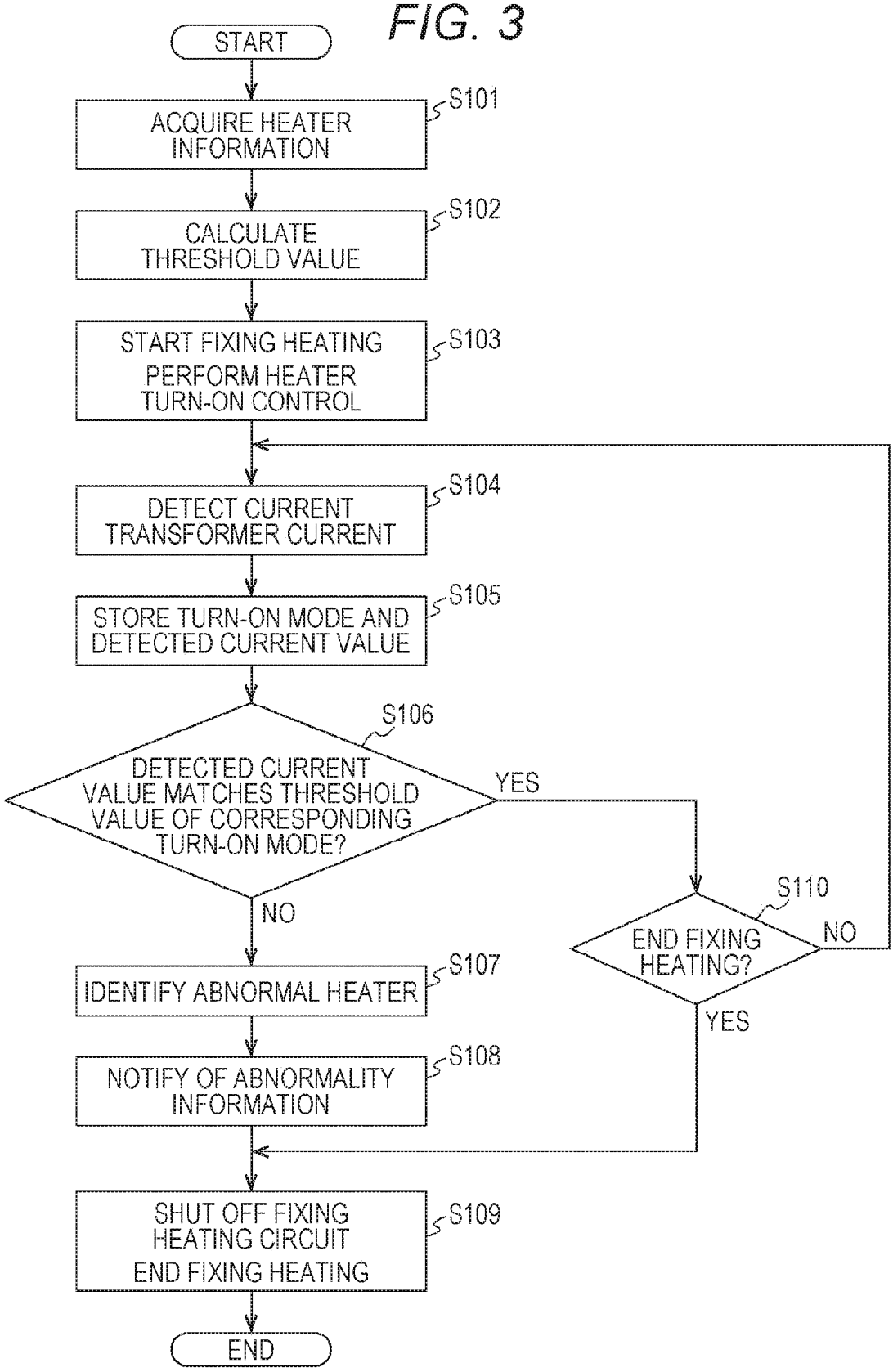
FIG. 3 is a flowchart illustrating contents of an energized state acquisition process executed by the control unit during fixing heating.

FIG. 3 is a flowchart illustrating contents of the energized state acquisition process during fixing heating performed by the control unit 5.

First, heater information is acquired (step S101) . Here, the heater information means information including a consumption current (root-mean-square value) assumed when a commercial power supply (100 V) is applied to the heaters H1 to H3, and a connection phase of each heater to the primary side of the current transformer 57.

The assumed consumption current in the heaters can be known from the specification of the heaters to be used.

However, in a stage of a component before assembling the apparatus, a plurality of pieces of each heater is selected, and AC 100 V is actually applied, and an average value of the current values measured at that time may be set as a consumption current value assumed in each heater.

Such heater information is stored in advance in, for example, the ROM 54 of the control unit 5, as a table (heater information table).

However, after the apparatus is delivered, a service person or a user may input the information from the operation panel 7 and store the information in the EEPROM 55.

FIG. 4 illustrates an example of the heater information table.

As illustrated in FIG. 4, the heater information table stores the assumed consumption current and the connection phase to the primary side of the current transformer 57 in association with each other, for each of the heaters H1 to H3. The consumption current of each heater in the table is only a numerical value in the specification, and actually has tolerance (error).

Incidentally, the connection phase of each heater is determined in advance so that an absolute value of a total value of the consumption current value to be detected (the consumption current of the heater connected in the reverse phase is subtracted from the consumption current of the heater connected in the normal phase) does not exceed a detection capability of the current transformer 57 in all turn-on combinations.

In the present embodiment, it is assumed that the detection capability of the current transformer 57 is 10 A, and connections are made so that the main heater H1 (5.5 A) has the normal phase, the complement heater H2 (4.5 A) has the reverse phase, and the heater H3 (3.0 A) has the normal phase.

The CPU 51 acquires the heater information from the heater information table (step S101), and temporarily stores the information in the RAM 53.

Next, the CPU 51 predicts a current (normal detection current) to be detected when the current normally flows through each of the heaters H1 to H3, for each combination of turn-on and turn-off of the heaters H1 to H3 (hereinafter, referred to as a "turn-on mode"), based on the heater information, and sets the current as a threshold value being a criterion for determination of an energization abnormality executed in a determination step S106 described later (step S102).

At this time, as illustrated in FIG. 5, a table (threshold value table) is created in which the combination of turn-on and turn-off of the heaters H1 to H3 in each of turn-on modes 1 to 8 is associated with the threshold value in the corresponding mode, and is stored in the EEPROM 55.

As illustrated in the threshold value table, when there are three heaters, eight turn-on modes 1 to 8 can be considered, and for example, in a case of the turn-on mode 1, the heaters H1, H2, H3 are all turned on and the heater H2 is connected in the reverse phase, so that a current value output from the current transformer 57 in the case is predicted to be 5.5 A-4.5 A+3.0 A=4.0 A, and the current value is set as the threshold value.

Incidentally, in the present embodiment, a threshold value table creation process in steps S101, S102 is executed for each time when the flowchart in FIG. 3 is started; however, the table may be created and stored only at the initial flowchart execution, and from the next start, steps S101, S102 may be skipped.

Next, to start fixing heating, turn-on control for each heater is performed (step S103).

That is, according to an instruction from the CPU 51, the energization control unit 56 operates the corresponding triacs 561 to 563, and the corresponding heaters H1, H2, H3 are energized and heating of the fixing roller 31 is started.

Incidentally, in the present embodiment, as the turn-on condition of the fixing heating, the main heater H1 is always turned on, and the complement heaters H2, H3 are turned on when necessary.

Since the main heater H1 is always turned on, there are four types (turn-on mode 1 to turn-on mode 4) as actual combinations of turn-on during fixing heating.

The turn-on mode is appropriately switched depending on the situation, according to an instruction from the control unit 5.

Which heater of the plurality of heaters H1, H2, H3 is selected and turned on is executed in energization control in a main flowchart (not illustrated) for controlling the entire printer 1.

For example, during warming up, all heaters are simultaneously turned on (turn-on mode 1), and after that, based on the size in the width direction (a direction orthogonal to the sheet passing direction) of the recording sheet and detection results of the thermistors 101 to 103, a turn-on mode is selected so that a heater necessary to maintain a fixing temperature is turned on.

When the fixing heating is started, the current value is detected via the current transformer 57 (step S104), and the turn-on mode and the detected current value at that time are stored in the EEPROM 55 (step S105).

Next, it is determined whether or not the detected current value matches the threshold value predicted in the present turn-on mode set in advance (see the threshold value table in FIG. 5) (step S106).

Here, "matches" means verifying whether or not the detected current is within a predetermined range (for example, within a range of ±5%) from the threshold value set for the corresponding turn-on mode. This is because the assumed consumption current value of each heater in FIG. 4 actually has tolerance for each component.

Therefore, according to the threshold value table in FIG. 5, for example, in a case of the turn-on mode 1, since the threshold value (normal detection current) is 4.0 A, when a current value I detected by the current transformer 57 at that time is within a range of $3.8\ A \leq I \leq 4.2\ A$, it is determined that the detected current value matches the threshold value of the corresponding turn-on mode.

If it is determined that the detected current matches the threshold value of the corresponding turn-on mode, the fixing heating is continued (step S106: YES), and when it is determined that the fixing heating should be ended instep S110 (step S110: YES), the energization control unit 56 shuts off the fixing heating circuit with the relay 564 and ends the fixing heating (step S109).

The control unit 5 determines that the fixing heating should be ended when a print job is ended, or a trouble such as a jam (paper jam) occurs.

If the determination is not made to end the fixing heating (step S110: NO), the fixing heating is continued, and returning to step S104, current value detection is performed by the current transformer 57.

When it is determined that the current value detected by the current transformer 57 does not match the threshold value predicted in the present turn-on mode set in advance in step S106 (step S106: NO), it is recognized that there is an abnormality in the energized state of any of the heaters, so that abnormal heater identification in step S107 is performed.

Specifically, based on the present turn-on mode instructed by the control unit 5 and the turn-on mode corresponding to the current value actually detected by the current transformer 57, a process is executed for identifying which heater is abnormal.

For example, when the present turn-on mode is the turn-on mode 1 but it is verified that 1.0 A is detected by the current transformer 57, 1.0 A during normal turn-on is a value in the turn-on mode 2, and the difference from the turn-on mode 1 is due to turn-off of the heater H3 (see the threshold value table in FIG. 5), so that it can be identified that the heater H3 is abnormally turned off.

Similarly, when the present turn-on mode is the turn-on mode 3 but 4.0 A is output from the current transformer 57, 4.0 A during normal turn-on is a value in the turn-on mode 1, so that it can be identified that the difference is due to abnormal turn-on of the heater H2. A heater with an abnormality can be identified by performing comparison similarly, in all other turn-on modes.

Incidentally, in this example, explanation is made without considering the tolerance in the assumed consumption current value of the heater for ease of understanding; however, when the actual detected current value of the current transformer 57 is, for example, 0.95 A, it is regarded as being within a range of the assumed tolerance of the threshold value (1.0 A) predicted in the turn-on mode 2, and it is determined that the turn-on mode corresponding to the detected current value is the turn-on mode 2. In the following, for example, the detected current value of the current transformer 57 within the tolerance of the threshold value 1.0 A is referred to as a detected current value "equivalent to 1.0 A."

FIGS. 6A to 6D each illustrate a result of an abnormal heater identification process in step S107 for each turn-on mode. In the turn-on modes 1 to 4, the detected current value of the current transformer 57 and the heater regarded as being in an energization abnormality are illustrated.

Incidentally, when the threshold value table in FIG. 5 is created in advance and stored in the ROM 54, the energization abnormality tables illustrated in FIGS. 6A to 6D maybe created in advance and stored in the ROM 54. In this case, the CPU 51, when it is determined that there is an energization abnormality in step S106 (step S106: NO), based on the turn-on mode and the detected current value of the current transformer 57 at that time, refers to the energization abnormality table, and identifies an abnormal heater.

For example, when fixing heating control is performed in the turn-on mode 2, the table in FIG. 6B is referred to, and when the detected current value of the current transformer 57 is equivalent to 1.0 A, the heaters are normally turned on; however, when the detected current value is equivalent to 4.0 A, it is determined that the heater H3 is abnormally turned on.

After the identification of the abnormal heater in step S107, information that the fixing heating is abnormal ("abnormality information") and information identifying the abnormal heater are displayed on the display unit 71 of the operation panel 7 to notify a user (step S108), and the relay 564 is operated and the fixing heating circuit is shut off and the fixing heating is ended (step S109).

Incidentally, at the time when it is regarded that there is an energization abnormality in step S106, shut off of the fixing heating circuit may be immediately performed (step S109), and after that, the abnormal heater identification process (step S107) and notification that energization is abnormal (step S108) may be performed.

(B) Energized State Acquisition Process During Standby

Next, the energized state acquisition process will be described of a state (during standby) in which the printer 1 ends a print job, and is shifted to an energy saving mode and on standby.

Figure 7:
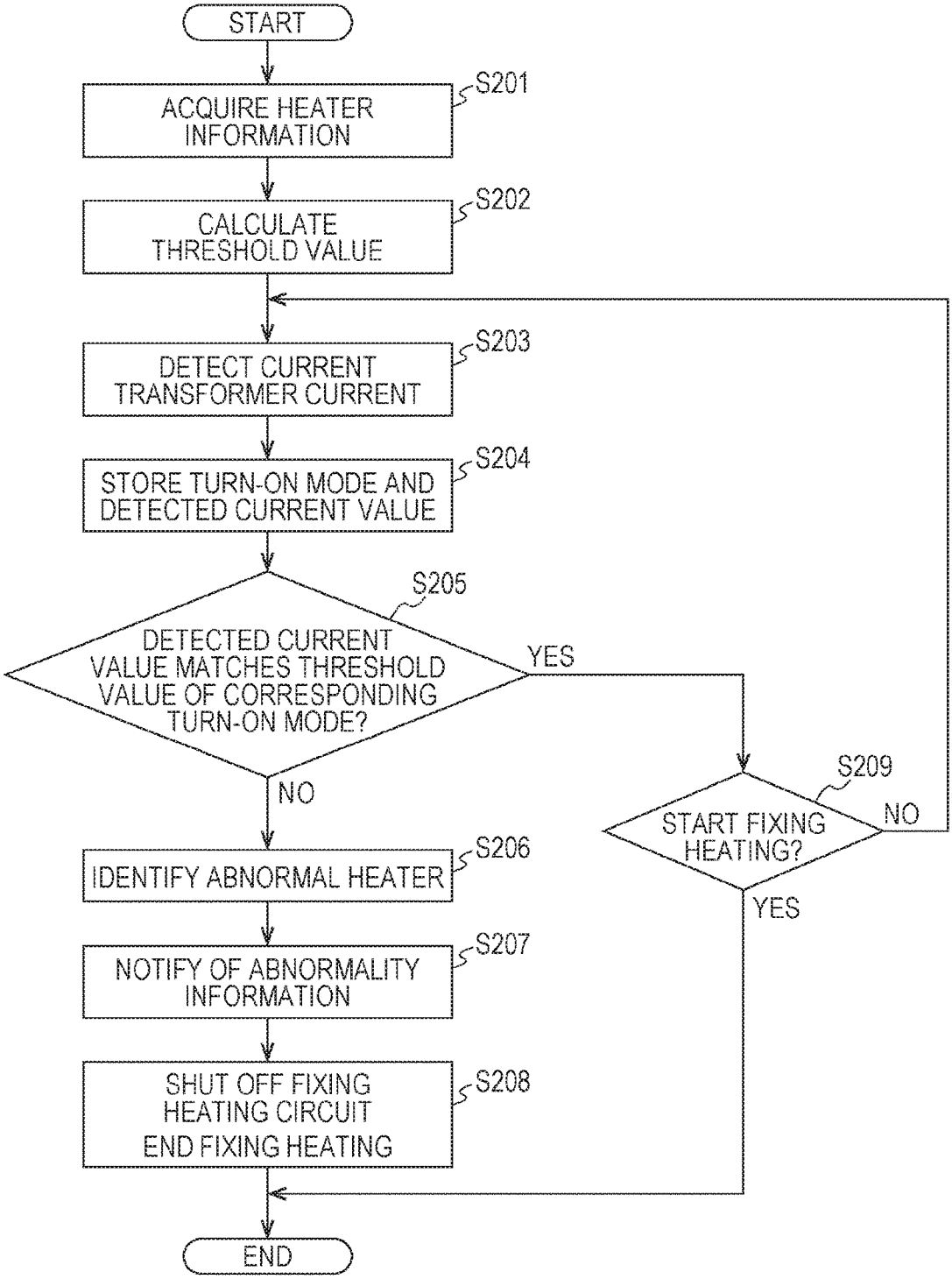
FIG. 7 is a flowchart illustrating contents of the energized state acquisition process executed by the control unit during standby.

FIG. 7 is a flowchart illustrating contents of the energized state acquisition process during standby.

A significant difference from the flowchart during fixing heating described in FIG. 3 is that the turn-on control for the heaters (step S103 in FIG. 3) is not performed and it is sufficient that only the threshold value table corresponding to the turn-on mode 8 is referred to.

Heater information acquisition in step S201 and threshold value calculation in step S202 are omitted when steps S101, 5102 in the flowchart in FIG. 3 have already been executed.

The current value output from the current transformer 57 is detected in step S203, and the turn-on mode (turn-on mode 8) and the detected current value at that time are stored (step S204), and it is determined whether or not the detected current value of the current transformer 57 matches the threshold value (0.0 A) of the turn-on mode 8 at that time (step S205).

When the both values do not match each other, that is, when the current is detected by the current transformer 57 although all the heaters should be turned off (step S205: NO), it is determined that the energized state is abnormal, and the abnormal heater identification process is performed (step S206).

In a standby state, since the turn-on mode is the turn-on mode 8, it can be identified that: when the detected current value is equivalent to 5.5 A (turn-on mode 4), the heater H1 is abnormally turned on; when the detected current value is equivalent to 4.5 A (turn-on mode 6), the heater H2 is abnormally turned on; and when the detected current value is equivalent to 3.0 A (turn-on mode 7), the heater H3 is abnormally turned on.

FIG. 8 illustrates an abnormal turn-on heater identified in step S206, as a table.

Similarly to step S107 in FIG. 3, a table in which the detected current value in the turn-on mode 8 is associated with the abnormal heater may be stored in advance in the ROM 54 or the EEPROM 55, and the CPU 51 may refer to the table and identify the abnormal heater.

Returning to FIG. 7, after the abnormal heater identification process in step S206, an abnormality information notification process is executed in which the fact that the apparatus is in an abnormal state and information of the heater identified as abnormal are displayed on the display unit 71 of the operation panel 7 (step S207), and further, the relay 564 is operated and the fixing heating circuit is shut off, and continuation of an abnormal turn-on state is prevented (step S208).

When it is determined that the apparatus is in normal operation in step S205 (step S205: YES), it is determined whether or not the fixing heating should be started (step S209), and when the fixing heating is not started (step S209:

NO), current detection by the current transformer 57 is continued (step S203), but when the fixing heating should be started for a reason such as receiving a print job (step S209: YES), the energized state acquisition process during standby is ended.

After that, the flowchart of the energized state acquisition process during fixing heating in FIG. 3 is executed.

As described above, in the present embodiment, information on current supplied to three heaters can be acquired by only one current transformer that can detect a low current value and is inexpensive, and energization abnormalities of the heaters can be reliably detected.

<Modifications>

In the above, the present invention has been described based on the embodiment; however, it goes without saying that the present invention is not limited to the above-described embodiment, and the following modifications can be considered.

(1) In the above embodiment, the process has been described that determines an energization abnormality of the heater, based on the detected current value of the current transformer 57 in each turn-on mode; however, when there is no energization abnormality, it is also possible to perform control so that the actual consumption current value of each heater is obtained individually and a total consumption current of the printer 1 does not exceed a predetermined value.

Figure 9:
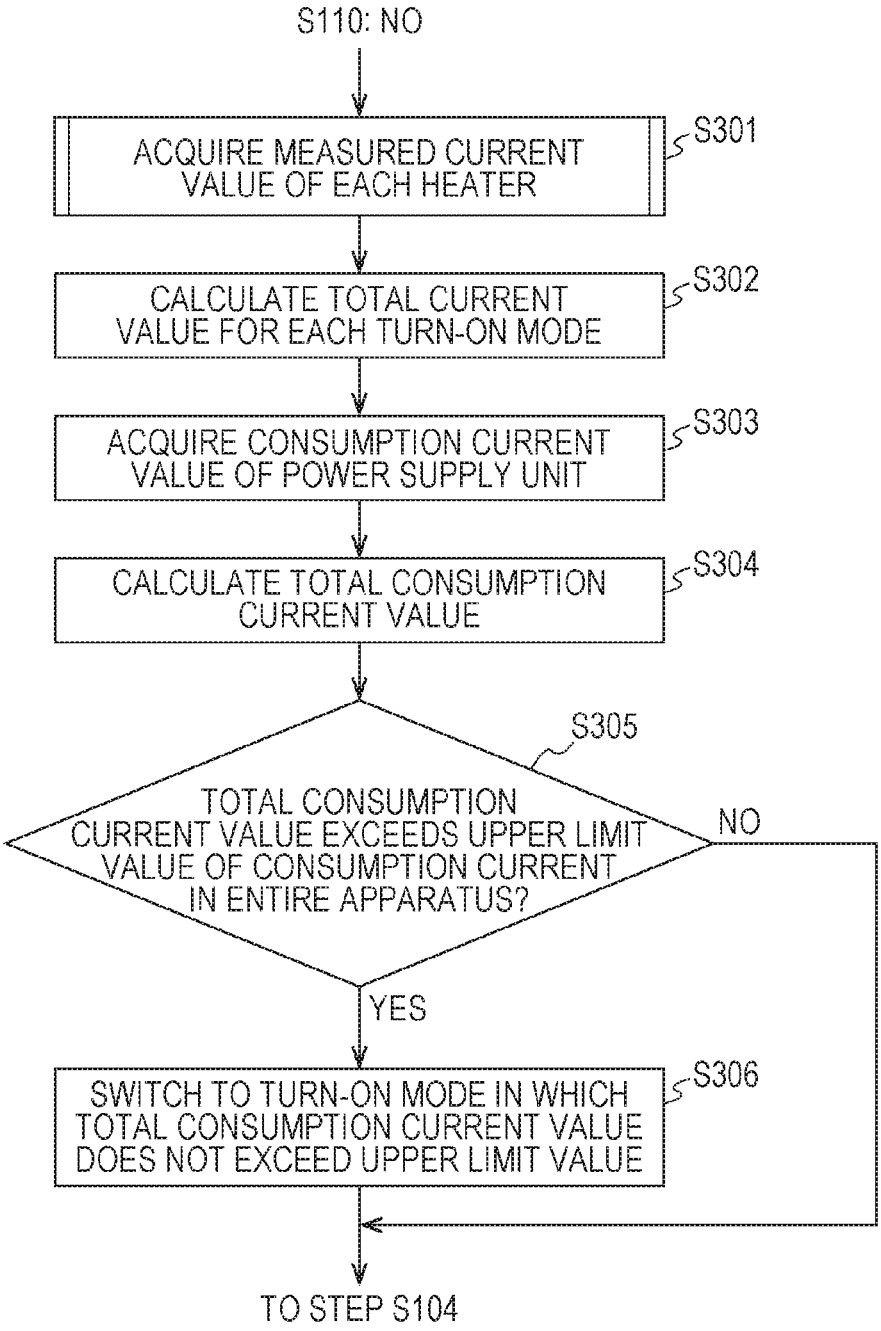
FIG. 9 is a partial flowchart illustrating contents of a modified part of the energized state acquisition process in a first modification of the present invention.

A flowchart in FIG. 9 is inserted in the middle from the determination of NO in step S110 to the return to step S104, in the flowchart of the energized state acquisition process described in FIG. 3, when the present modification is performed.

That is, when it is determined that the apparatus is normally energized in step S106 in FIG. 3 (step S106: YES), and determined that the fixing heating is not ended (step S110: NO), a measured current value acquisition process is executed to acquire a measured value of the individual current value of each heater in step S301 in FIG. 9.

This is because, as described above, the consumption current value in the heater information table in FIG. 4 is only an assumed value in the specification, and actually has variation (tolerance) for each component, so that in obtaining the total consumption current value of the printer 1, it is necessary to accurately measure the current value supplied to each heater.

Figure 10:
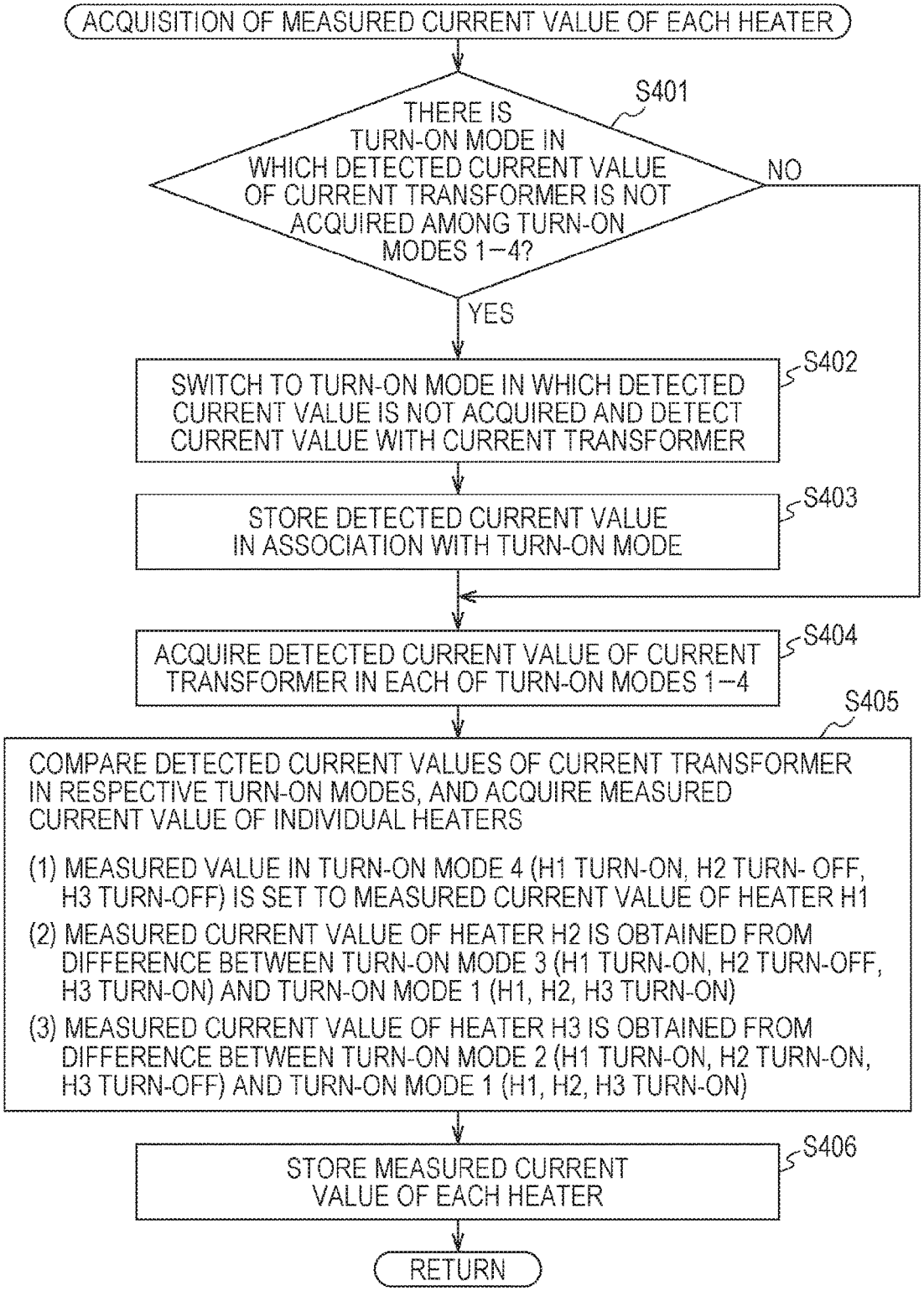
FIG. 10 is a flowchart illustrating a subroutine of a measured current value acquisition process for each heater in step S301 in FIG. 9.

FIG. 10 is a flowchart illustrating contents of a subroutine of the measured current value acquisition process for each heater.

First, in step S401, it is determined whether or not there is a turn-on mode in which the detected current value of the current transformer is not acquired, among the turn-on modes 1 to 4. When acquisition of the detected current value is completed in all the turn-on modes (step S401: NO), the value is already stored in step S105 in FIG. 3 and it is not necessary to detect again, so that steps S402, 5403 are skipped; however, when there is a turn-on mode in which the detected current value is not acquired (step S401: YES), the turn-on mode is switched to the mode in which the detected current value is not acquired, and the current value is detected by the current transformer 57 (step S402).

Then, the detected current value of the current transformer 57 is stored in the EEPROM 55 in association with the turn-on mode (step S403).

Incidentally, when the turn-on mode is switched in step S402, the turn-on mode is preferably returned to its original mode immediately after the detected current value of the current transformer 57 is acquired. This is for the purpose of preventing influence to temperature control for the fixing roller 31.

Then, in step S404, the detected current values of the current transformer 57 corresponding to all the turn-on modes 1 to 4 stored in the EEPROM 55 are read and acquired (step S404), and those detected current value are compared with each other and the measured current value of each heater is acquired (step S405).

Specifically, (i) an absolute value of the detected current value in the turn-on mode 4 (H1 turn-on, H2 turn-off, H3 turn-off) is set to a measured current value Ih1 of the heater H1.

(ii) An absolute value of a difference between the detected current values of the turn-on mode 3 (H1 turn-on, H2 turn-off, H3 turn-on) and the turn-on mode 1 (H1, H2, H3 turn-on) is set to a measured current value Ih2 of the heater H2. (iii) An absolute value of a difference between the detected current values of the turn-on mode 2 (H1 turn-on, H2 turn-on, H3 turn-off) and the turn-on mode 1 (H1, H2, H3 turn-on) is set to a measured current value Ih3 of the heater H3.

The measured current values Ih1 to Ih3 of the heaters H1 to H3 acquired as described above are stored in the EEPROM 55 (step S406), and the process returns to the flowchart in FIG. 9.

Incidentally, in the above, a difference between two turn-on modes is taken to obtain each of the measured current values Ih2 and Ih3 of the heaters H2, H3; however, it may be detected by independently turning on the heater to be detected. For example, the absolute values of the detected current values of the current transformer 57 in the turn-on mode 6 in which the heater H2 is independently turned on and the turn-on mode 7 in which the heater H3 is independently turned on may be used as the measured current values Ih2 and Ih3, respectively. In this case, in steps S401 to S404 in FIG. 10, the turn-on mode is switched to the mode in which the detected current value of the current transformer 57 is not acquired, among the turn-on modes 4, 6, 7, and the absolute value of the detected current value at that time is acquired and stored.

Next, in step S302 in FIG. 9, based on the measured current values Ih1 to Ih3 of the heaters, for each turn-on mode, a total current value of the measured current value of the heater to be turned on in the turn-on mode is calculated.

In accordance with this, a consumption current value other than the fixing heating, a consumption current value of the power supply unit 6 in the present embodiment, is acquired (step S303). This is achieved by disposing a current detection unit 61 having a similar configuration including the through-type the current transformer 57, the resistor 59, and the current detection circuit 58 in the middle of the current supply line from the AC power supply 60 to the power supply unit 6 in FIG. 2, and inputting the detected current value as a consumption current value 14 other than the fixing heating to the control unit 5.

Then, a total of the measured current value of the heater in the present turn-on mode and a total of the consumption current value I4 of the power supply unit 6 are added together and a total consumption current value Ia is calculated (step S304), and it is determined whether or not the total consumption current value Ia exceeds an upper limit value of the consumption current in the entire apparatus of the printer 1 (step S305). Incidentally, in the field of the image forming apparatus in Japan, the upper limit value of the consumption current in the entire apparatus to the commercial power supply 100 V is regulated to be 15 A.

If the total consumption current value Ia exceeds the upper limit value of the consumption current allowed for the entire apparatus (step S305: YES), the turn-on mode is switched to a mode in which the total consumption current value Ia does not exceed the upper limit value (step S306).

For example, in a case of the turn-on mode 1 (all the heaters are turned on), when the upper limit value of the consumption current is exceeded, the mode is switched to the turn-on mode 2 (or turn-on mode 3 or 4 If the current upper limit value is still exceeded), and then the process proceeds to step S104 in FIG. 3.

In step S305, when the total consumption current value Ia in the present turn-on mode does not exceeds the upper limit value of the consumption current, step S306 is skipped, and the process proceeds to step S104 in FIG. 3, and the fixing heating is continued without changing the turn-on mode.

According to this modification, it is possible to perform control so that the total consumption current value of the printer 1 does not exceed the upper limit value of the consumption current of the apparatus.

However, the control may be performed so that only the upper limit value of the total current value of the heaters is determined, and the turn-on mode of the heaters is switched so that the value is not exceeded.

(2) In addition, the apparatus may be configured so that the total power consumption of the entire apparatus can be monitored.

Figure 11:
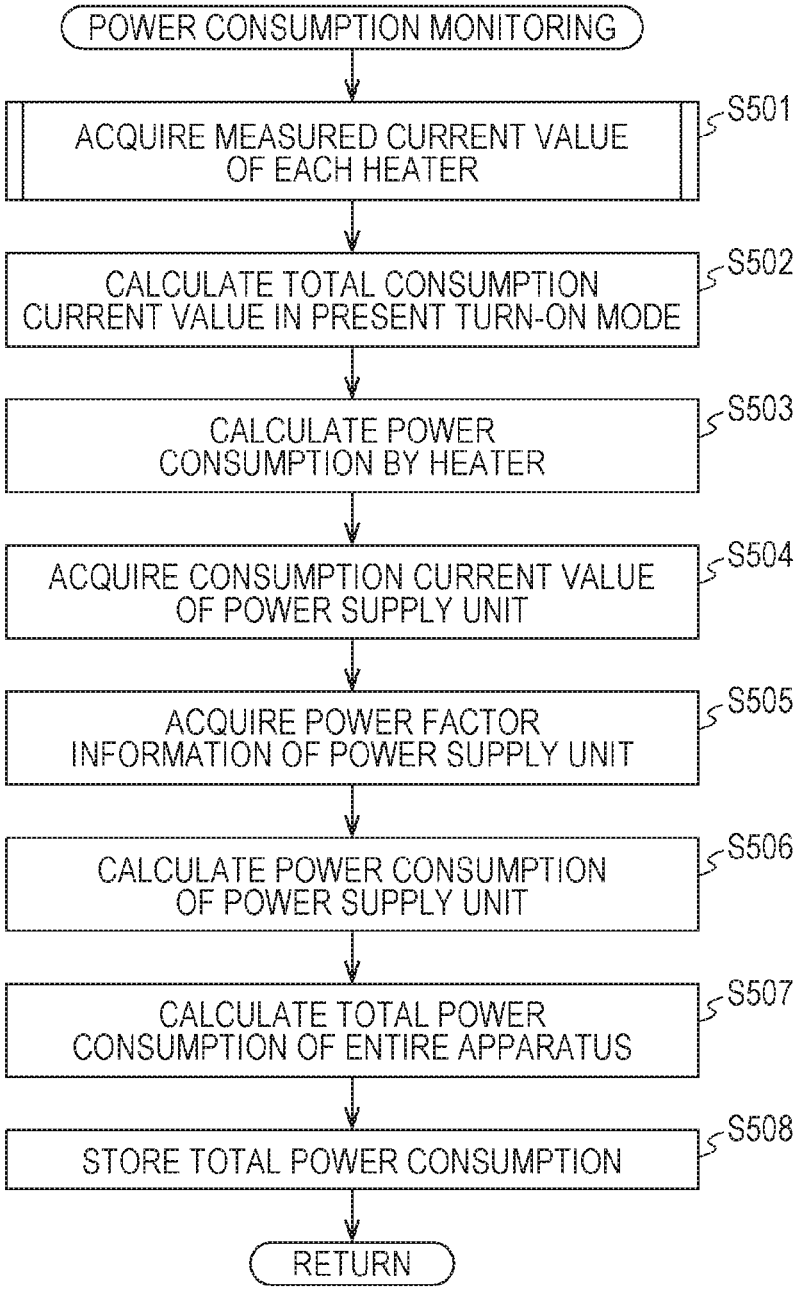
FIG. 11 is a flowchart illustrating contents of a power consumption monitoring process according to a second modification of the present invention.

FIG. 11 is a flowchart executed by the control unit 5 for performing the present modification, and for example, is performed as a subroutine of a main flowchart (not illustrated) for controlling operation of the entire apparatus.

First, the measured current value acquisition process is executed to acquire individual measured value of the current value of each of the heaters H1 to H3 in step S501 in FIG. 11.

Contents of the measured current value acquisition process for the heaters are the same as step S301 in FIG. 9 in the modification (1), and a process similar to the flowchart in FIG. 10 is executed. Therefore, when the apparatus is configured to perform the flowchart in FIG. 9 before performing the flowchart in FIG. 11, the measured current value of each of the heaters H1 to H3 acquired in step S301 in FIG. 9 can be used as it is.

Based on the measured current values of the heaters, a total consumption current value in the present turn-on mode is calculated (step S502).

Then, the calculated total consumption current value is multiplied by the effective voltage 100 V of the commercial power supply 60, and power consumption (first power consumption) of the heater presently turned on is calculated (step S503).

Next, as the consumption current other than the fixing heating, the consumption current in the power supply unit 6 is acquired by the current detection unit 61 (see FIG. 2, modification (1)) (step S504).

Then, a value of a power factor r (power factor information) obtained in advance for the power supply unit 6 and stored in the ROM 54 is read and acquired (step S505), and the consumption current of the power supply unit 6 acquired in step S504, the effective voltage 100 V of the commercial power supply 60, and the power factor r are multiplied together and the power consumption (second power consumption) in the power supply unit 6 is calculated (step S506).

The power consumption by the heater obtained in step S503 and the power consumption of the power supply unit 6 obtained in step S506 are added together and the total power consumption of the entire apparatus is calculated (step S507), and the total power consumption is stored in the EEPROM 55 (step S508).

The monitoring of the total power consumption is periodically executed, and for example, the present total power consumption may be sequentially displayed on the display unit 71 of the operation panel 7, and values of the total power consumption over a certain period is stored, and a history of the previous total power consumption is displayed on the display unit 71 or printed on a recording sheet by a user's instruction via the operation panel 7, whereby the monitoring can be used as a reference during management of the power consumption of the printer 1.

(3) In the above embodiment, the plurality of heaters respectively having current values different from each other has been used; however, when there are two or more heaters having the same current value, a case occurs where a difference is not generated between the detected current values of the current transformer 57 for each of the turn-on modes 1 to 4 during fixing heating, and in this case, a problem occurs in determination of an energization abnormality and acquisition of a measured current value of the individual heater.

Therefore, in the present modification, when there are two or more heaters having the same specification on the assumed power consumption, the apparatus is configured so that the number of turns of the current supply line to the core of the current transformer 57 is made different between the heaters, and secondary side outputs by the energization of the heaters are different from each other. Incidentally, in the present embodiment, a simple "insertion" of the current supply line to the current transformer 57 is regarded that the number of turns is one.

Figure 12:
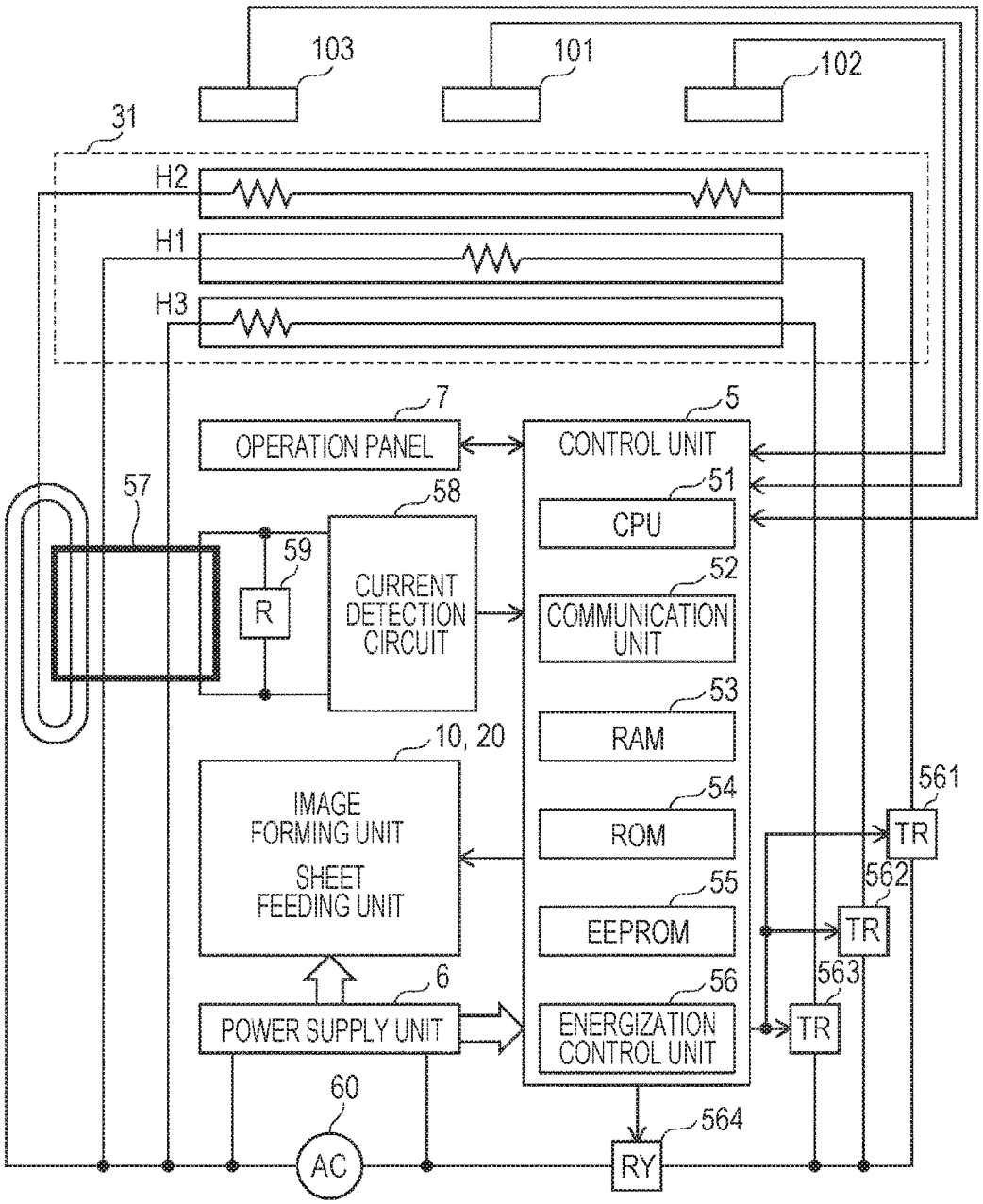
FIG. 12 is a diagram illustrating a connection state of current supply lines of heaters to a current transformer in a printer according to a third modification of the present invention.

For example, when the consumption current in the specification of the heater H1 is 5.5 A, and the consumption currents of the heaters H2 and H3 in the specification are both 3.5 A, as illustrated in FIG. 12, the current supply line of the heater H2 is wound around the core of the current transformer 57 twice to have the reverse phase to those of the current supply lines of the other heaters H1, H3.

Thus, the secondary side output of the current transformer 57 of when the heater H2 is energized can be regarded as 7.0 A that is twice as large.

FIG. 13 is a diagram illustrating a heater information table at this time. FIG. 14 is obtained when the threshold value table for each turn-on mode is created based on the FIG. 13, and the threshold values to the turn-on modes 1 to 4 during fixing heating are made to be different from each other, and the turn-on modes can be sufficiently distinguished from each other even when the tolerance of the consumption current of each heater is considered, so that identification of the abnormal heater in step S107 in FIG. 3 and step S206 in FIG. 7, and acquisition of the measured current value of the individual heater in step S301 in FIG. 9 become easy. However, it should be noted that the actual measured current value of the heater H2 is half of the value obtained from the detected current value of the current transformer 57.

(4) In the above modifications (1), (2), to obtain the consumption current of the parts other than the fixing heating, the current detection unit 61 is separately provided, and the current flowing through the current supply line of the power supply unit 6 is detected by the current detection unit 61; however, in the present modification, the consumption current of the power supply unit 6 is detected by connecting to the current transformer 57 for detecting the current value of the heater without providing the current detection unit 61.

Also in the present modification, the connection phase of each current supply line to the primary side of the current transformer 57 is set so that the consumption current of the power supply unit 6 and the current supplied to each heater are adjusted, and the current value output from the secondary side of the current transformer 57 does not exceed the detection capability of the current transformer 57.

Figure 15:
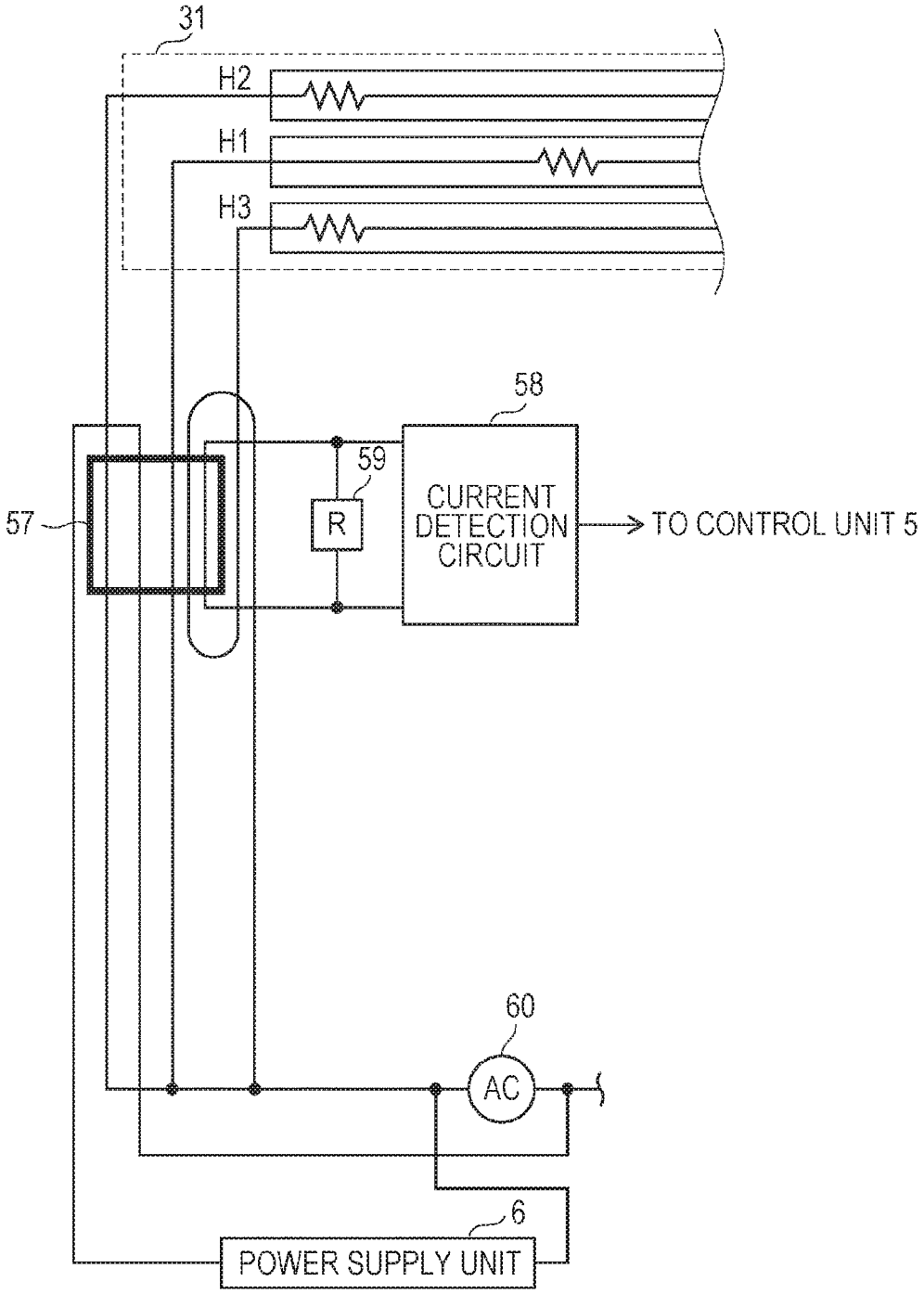
FIG. 15 is a diagram illustrating a connection state of current supply lines to a power supply unit to a current transformer in a fourth modification of the present invention.
Figure 18:
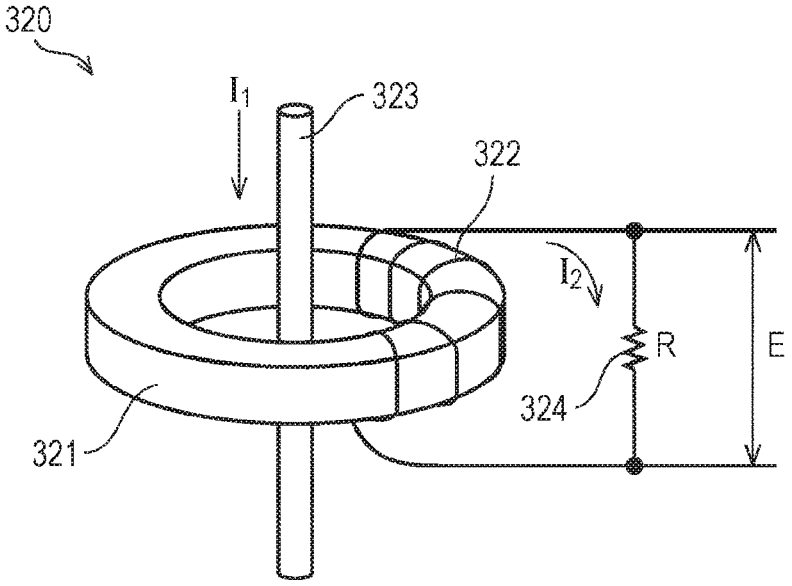
FIG. 18 is a schematic diagram illustrating a configuration of a through-type current transformer.
Figure 19:
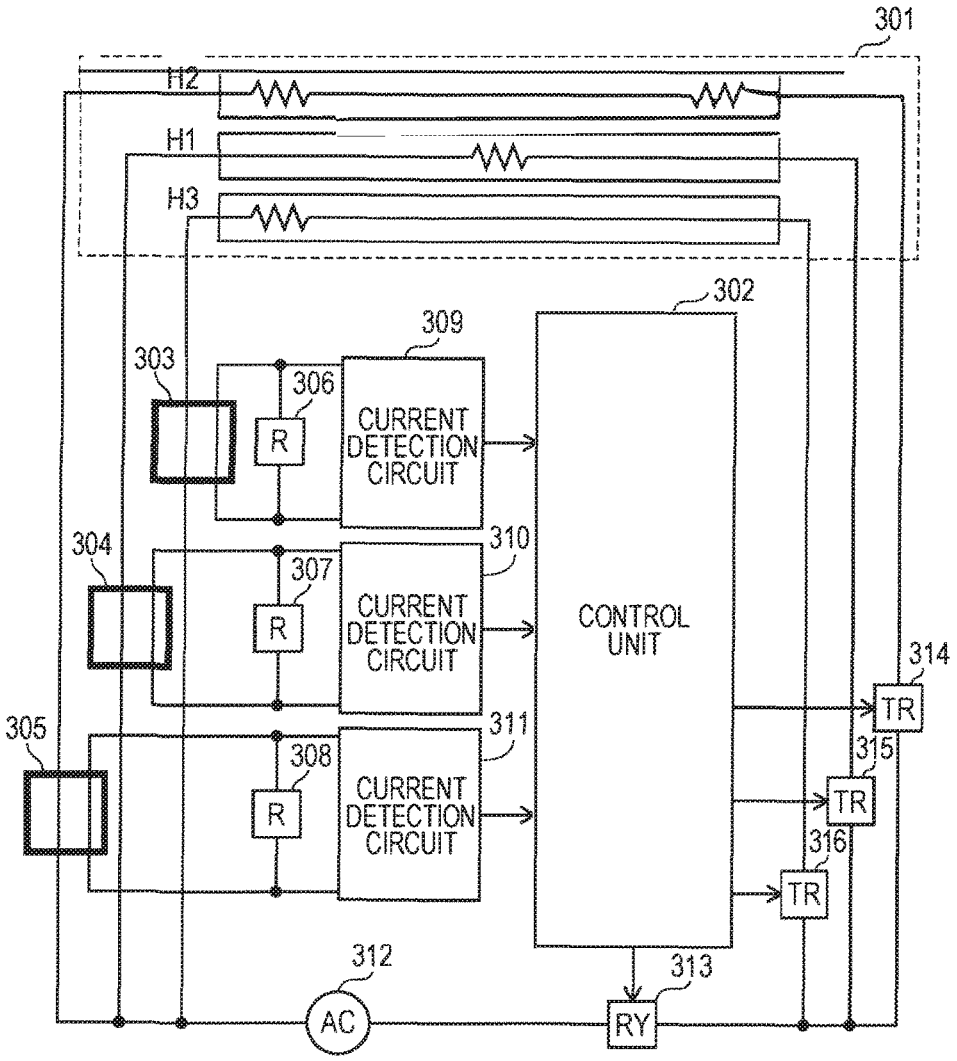
PRIOR ART FIG. 19
FIG. 19 is a diagram for explaining a connection state to the current transformer according to a first related art of the present invention.
Figure 20:
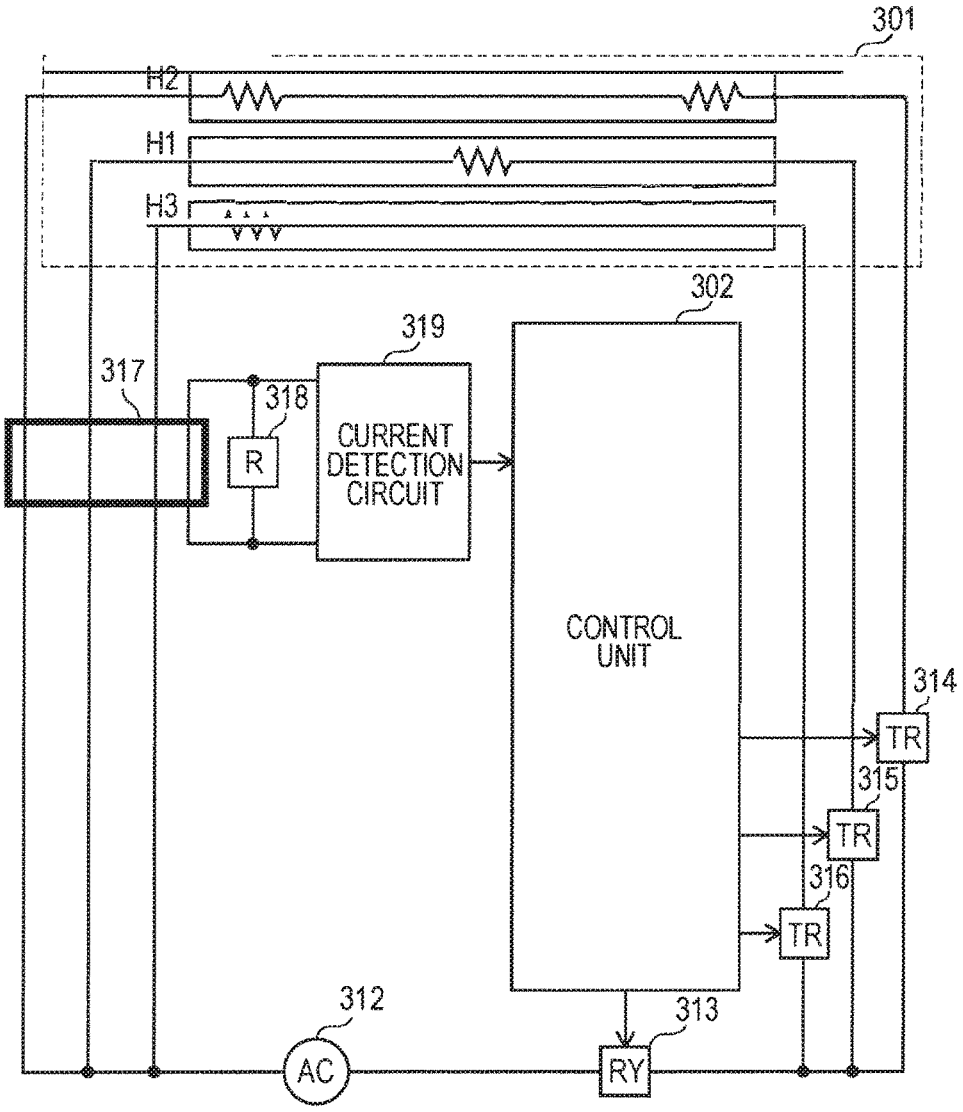
PRIOR ART FIG. 20
FIG. 20 is a diagram for explaining a connection state to the current transformer according to a second related art of the present invention.

FIG. 15 is a diagram illustrating a connection state of the current supply lines of the heaters H1 to H3 and the power supply unit 6 to the primary side of the current transformer 57 in the present modification when it is assumed that the detection capability of the current transformer 57 is 10 A.

As illustrated in FIG. 15, the current supply lines of the heaters H1 and H2 are connected to the current transformer 57 in the normal phase, and the current supply lines of the heater H3 and the power supply unit 6 are connected to the current transformer 57 in the reverse phase.

FIG. 16 is a heater information table in the present modification, and in addition to the consumption current and the connection phase of each of the heaters H1 to H3, information on the consumption current and the connection phase of the power supply unit 6 is added.

From the table of FIG. 16, it can be seen that connection to the current transformer 57 is made so that the main heater H1 (consumption current: 5.5 A) and the complement heater H2 (consumption current: 4.5 A) have the normal phase, the heater H3 (consumption current: 3.0 A) has the reverse phase, and the power supply unit 6 (power consumption: 1.5 A to 3.5 A) has the reverse phase. Incidentally, since the consumption current of the power supply unit 6 fluctuates in accordance with an operation state of the printer 1, the consumption current is in a certain range (in the present embodiment, 1.5 A to 3.5 A).

In addition, in FIG. 17, detected current value ranges (that corresponds to the threshold value in FIG. 5) are obtained of the current transformer 57 at the time of normal turn-on for the turn-on modes 1 to 8, based on the heater information table.

The flowchart of the energized state acquisition process during fixing heating performed in this modification and the flowchart of the energized state acquisition process during standby are basically the same as those described in FIG. 3 and FIG. 7, and the tables to be applied only differ in accordance with the connection state to the current transformer 57 as illustrated in FIG. 16 and FIG. 17, so that the description is omitted.

(5) In the above embodiment, the heater information is acquired from the heater information table in FIG. 4 (step S101 in FIG. 3), and based on the information, the threshold values in the turn-on modes 1 to 8 as illustrated in FIG. 5 are calculated and predicted (step S102 FIG. 3); however, the threshold value table illustrated in FIG. 5 may be created and stored in the ROM 54 or the EEPROM 55 in advance, and the threshold value of the corresponding turn-on mode may be read from the table if necessary.

(6) In the above embodiment, when it is determined that the energized state is abnormal (step S106 in FIG. 3: NO, step S205 in FIG. 7: NO), the relay 564 is operated and energization to the heater is shut off (step S109 in FIG. 3, step S208 in FIG. 7); however, when a thermostat is installed in the fixing unit 30, and the power supply is shut off by the thermostat without waiting for the operation of the relay 564 when the fixing roller 31 is excessively heated to a predetermined temperature or higher, safety is increased.

(7) In the above embodiment, the example has been described in which three heaters are used; however, when more heaters (N pieces) are used, there is a possibility that the heaters cannot be connected to one current transformer 57. In this case, the above embodiment and the modifications may be applied in a manner such that a plurality of current transformers (M pieces: M<N) is used, in which the number of current transformers is less than that of the heaters, and at least one heater is connected to each of the current transformers, and the heater in the normal phase connection and the heater in the reverse phase connection are combined for the current transformer to which the plural heaters are connected. Even in this case, there is no need to use the same number of current transformers as the heaters, so that cost reduction is achieved by that amount.

(8) In the above embodiment, the tandem type printer has been described as an example; however, as far as it is an image forming apparatus that uses a plurality of heaters in a fixing unit, the present invention can also be applied to a facsimile machine and a copying machine, and a monochrome image forming apparatus.

(9) In addition, contents of the above embodiment and the modifications may be combined as much as possible.

The present invention is suitable as a technique for acquiring an energized state to a heater in an image forming apparatus that uses a plurality of heaters in a fixing unit.

According to an embodiment of the present invention, the current supply lines to the plurality of heaters connected to the through-type current transformer are configured such that a line connected in additive polarity connection and a line connected in subtractive polarity connection are included and a current value corresponding to a difference between lines of magnetic force generated by the current supply lines is output from the current transformer, and based on an output value from the current detection unit, and connection information and turn-on information on a combination of heaters to be turned on, information on an energized state of the plurality of heaters is acquired, so that it is possible to know the energized state to the plurality of heaters while using the current transformer that can detect a small current and is inexpensive.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus that includes a plurality of heaters as a heat source of a heating rotating body of a fixing unit and in which a combination of each of the heaters to be turned on can be changed, the image forming apparatus comprising:

a current detection unit including a through-type current transformer in which current supply lines are inserted into or wound around a through hole at a center portion of a ring-shaped core;

a turn-on information acquisition unit that acquires information on a turn-on mode indicating the combination of each of the heaters to be turned on as turn-on information;

a connection information acquisition unit that acquires connection information on additive polarity connection and subtractive polarity connection of the heaters, wherein the current supply lines to the plurality of heaters include an additive polarity connection line inserted into or wound around the through hole of the core of the current transformer in additive polarity, and a subtractive polarity connection line inserted into or wound around the through hole of the core of the current transformer in subtractive polarity; and an energization information acquisition unit that acquires information on an energized state of the plurality of heaters as energization information, based on the turn-on information, the connection information, and a current value output from the current detection unit.

2. The image forming apparatus according to claim 1, further comprising:

a predicted value acquisition unit that acquires a predicted value predicted to be output from the current detection unit in a present turn-on mode;

a verification unit that performs verification of the predicted value with a current value actually output from the current detection unit; and a determination unit that determines whether or not the energized state is abnormal, based on a result of the verification.

3. The image forming apparatus according to claim 2, wherein the predicted value acquisition unit calculates and acquires the predicted value, based on a consumption current value assumed for each of the heaters, the turn-on information, and connection information of each of the heaters.

4. The image forming apparatus according to claim 2, wherein based on a consumption current value assumed for each of the heaters, the turn-on information, and connection information of each of the heaters, the predicted value is obtained in advance for each turn-on mode and stored as a table, and the predicted value acquisition unit reads and acquires a predicted value corresponding to a present turn-on mode from the table.

5. The image forming apparatus according to claim 2, wherein the determination unit determines that the energized state is abnormal when a current is detected in the current detection unit during execution of a turn-on mode in which all heaters are to be turned off.

6. The image forming apparatus according to claim 2, further comprising a shut off unit that shuts off supply of power to the plurality of heaters when the determination unit determines that the energized state is abnormal.

7. The image forming apparatus according to claim 1, wherein when there are two or more heaters each having an identical assumed consumption current among the plurality of heaters, a difference is provided in the number of turns to be wound around the core of the current transformer of the current supply lines of respective heaters.

8. The image forming apparatus according to claim 1, further comprising a control unit that turns on the plurality of heaters in different turn-on modes, and based on an output value of the current detection unit in each of the turn-on modes, acquires a measured value of a consumption current of each of the heaters, and calculates a total consumption current of each of the heaters being turned on, from a present turn-on mode and the acquired measured value of the consumption current, and controls the consumption current of the entire apparatus, based on the calculated value.

9. The image forming apparatus according to claim 8, further comprising a power-supply-unit-consumption-current acquisition unit that acquires a consumption current of a power supply unit including at least a low voltage power supply, other than the heaters of the apparatus, wherein the control unit, when a sum total of measured values of the consumption current of the power supply unit and the consumption current of each of the heaters being turned on exceeds a specified value, switches a combination of turn-on of the plurality of heaters to a combination in which the consumption current is less.

10. The image forming apparatus according to claim 9, further comprising:

a total power calculation unit that calculates a sum total of a first power consumption calculated from the total consumption current of each of the heaters being turned on, and a second power consumption calculated from the consumption current of the power supply unit and a power factor set in advance; and a storage unit that stores the calculated sum total of the power consumption.

11. The image forming apparatus according to claim 9, wherein the current supply lines to the power supply unit are connected to the current transformer of the current detection unit in additive polarity connection or subtractive polarity connection, and the consumption current of the power supply unit is calculated based on the turn-on information, a connection state of the current supply lines to the power supply unit to the current transformer, and the current value output from the current detection unit.

12. The image forming apparatus according to claim 1, wherein when the number of the plurality of heaters is N, the current detection unit includes a plurality of the current transformers, the number of the current transformers being M less than N, and at least one of the heaters is allocated for each of the current transformers, and for each of the current transformers to which the plurality of heaters is allocated, a part of the current supply lines of the plurality of allocated heaters is connected in additive polarity, and a rest of the current lines of the heaters is connected in subtractive polarity.

* * * * *